US009070526B2

(12) United States Patent
Owada et al.

(10) Patent No.: US 9,070,526 B2
(45) Date of Patent: Jun. 30, 2015

(54) LIGHT SOURCE DEVICE, LIGHT IRRADIATING APPARATUS EQUIPPED WITH LIGHT SOURCE DEVICE, AND METHOD OF PATTERNING SELF-ASSEMBLED MONOLAYER USING LIGHT IRRADIATING APPARATUS

(71) Applicant: Ushio Denki Kabushiki Kaisha, Tokyo (JP)

(72) Inventors: Tatsushi Owada, Hyogo (JP); Shinji Suzuki, Tokyo (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/294,177

(22) Filed: Jun. 3, 2014

(65) Prior Publication Data

US 2014/0361196 A1 Dec. 11, 2014

(30) Foreign Application Priority Data

Jun. 5, 2013 (JP) ..... 2013-118651

(51) Int. Cl.
*G21K 5/00* (2006.01)
*H01J 21/02* (2006.01)

(52) U.S. Cl.
CPC ..... *H01J 21/02* (2013.01)

(58) Field of Classification Search
USPC ..... 250/493.1, 494.1, 504 R, 504 H; 315/246, 50, 276, 312, 309
See application file for complete search history.

(56) References Cited

U.S. PATENT DOCUMENTS 5,791,767 A 8/1998 Inoue et al.
2006/0038505 A1* 2/2006 Mizojiri et al. ..... 315/239
2010/0109522 A1* 5/2010 Haacke et al. ..... 313/570

FOREIGN PATENT DOCUMENTS

JP H06-97048 A 4/1994

OTHER PUBLICATIONS

Hiroyuki Sugimura, "Photo Micropatterning of Organic Monolayer Films," The Vacuum Society of Japan, Journal, 2005, pp. 506-510, vol. 48, No. 9, Japan.

* cited by examiner

*Primary Examiner* — Nicole Ippolito

(57) ABSTRACT

A light source device is disclosed that can be regarded as a point light source and that emits vacuum ultraviolet light at a sufficiently high optical intensity. The device has a lamp housing to house a flash lamp and a parabolic mirror. Light emitted from the flash lamp is converted to parallel light by the parabolic mirror, and the parallel light exits the lamp housing from a quartz window. The flash lamp has a pair of electrodes, and the distance between the electrodes is 12.5 mm or less. The filler gas pressure is between 2 atm and 8 atm. A current is fed to the flash lamp from an electricity feeding unit. This current requires 8 μs or less from the start of discharge until the current value reaches the peak value. The peak current value is 1500 A or more. The flash lamp emits light including vacuum ultraviolet light.

8 Claims, 10 Drawing Sheets

LIGHT SOURCE DEVICE, LIGHT IRRADIATING APPARATUS EQUIPPED WITH LIGHT SOURCE DEVICE, AND METHOD OF PATTERNING SELF-ASSEMBLED MONOLAYER USING LIGHT IRRADIATING APPARATUS

FIELD OF THE INVENTION

The present invention relates to a light source device for emitting vacuum ultraviolet light, a light irradiating apparatus equipped with the light source device, and a method of patterning a self-assembled monolayer using the light irradiating apparatus.

DESCRIPTION OF THE RELATED ART

In recent years, vacuum ultraviolet light (may be referred to as "VUV light" or simply "VUV" hereinafter) that has a wavelength equal to or shorter than 200 nm is used in various fields. In a recent developed approach, for example, a pattern forming process with a photoresist is not used, but VUV light and a mask are used, and a chemical reaction is caused with direct light such that a self-assembled monolayer (hereinafter, referred to as "SAM layer") is patterned. For example, Non Patent Literature 1 (will be identified below) discloses that an optical patterning process for the SAM layer can be performed with the VUV light, without relying upon a particular functional group. Specifically, an excimer lamp having a wavelength of 172 nm, which is used to remove or eliminate pollutants (contaminants) constituted by organic substances, is employed as a light source for exposure. This is a method that focuses an oxidative removing-and-decomposing reaction of the SAM layer by the VUV light. This method is expected to realize the use of the SAM layer in the optical microfabrication (micro-processing) in a variety of ways.

On the other hand, it is known that light having a wavelength equal to or shorter than 180 nm among the VUV light can particularly be used for high speed surface reforming (modification) such as asking.

Conventionally, a low-pressure mercury lamp that has a bright line at a wavelength of 185 nm is used as a vacuum ultraviolet light source (may be referred to as "VUV light source" hereinafter). In recent years, a xenon excimer lamp that can emit light at a wavelength of 172 nm is often used as the VUV light source, as mentioned earlier.

In general, the lamp that emits the VUV light has a long light emitting portion (luminous portion), i.e., long emission length (luminous length). For example, the low pressure mercury lamp (trade name "UL0-6DQ" manufactured by USHIO INC.) has an emission length of 10 cm. For example, the excimer light unit that has the xenon excimer lamp therein (trade name "SUS06" manufactured by USHIO INC.) has an emission length of 10 cm.

The light emitted from such lamp is diffusing light (a diverging ray). When the emission length of the light source (lamp) is relatively long and the light source emits diffusing light, such light source is not suitable for fine and selective surface reforming (patterning) with a mask. In other words, when an object is irradiated with such light and the exposure is performed, the limit on the pattern size for appropriate resolution is some 100 μm in terms of line pattern width because of diffraction or sneaking of the diffusing light.

In order to perform finer patterning, parallel light or substantially parallel light is needed. For example, Patent Literature 1 (Japanese Patent Application Laid-Open Publication No. Hei 6-97048) discloses a configuration that employs a point light source (lamp), a light focusing (condensing) mirror and a collimator lens to obtain parallel light or substantially parallel light. Thus, a lamp that has a short emission length and can be regarded as a point light source is necessary to obtain the parallel light or the substantially parallel light. If an illumination optical system is configured with the above-mentioned parallel light or the substantially parallel light such that the exposure can be performed with reduced sneaking of the light, then it is possible to realize the patterning that has the pattern size equal to or smaller than several μm.

LISTING OF REFERENCES

Patent Literature

Patent Literature 1: Japanese Patent Application Laid-Open Publication No. Hei 6-97048

Non Patent Literature

Non Patent Literature 1: "Optical Microfabrication of Organic Monolayer," Hiroyuki Sugimura, Vacuum, The Vacuum Society of Japan, Vol. 48, No. 9, Pages 506-510 (2005)

SUMMARY OF THE INVENTION

As described above, if patterning with a high resolution should be performed, it is necessary to use a light source that can be regarded as a substantially point light source so as to perform the exposure with reduced sneaking of light. When the patterning is carried out with direct light, which uses the VUV light, a point light source is also needed, and a condition of "emission length being equal to or less than 15 mm" is required. However, when the low pressure mercury lamp or the excimer lamp is employed, it is difficult to manufacture a light source that has an emission length equal to or less than 15 mm, has a long life, which is practically sufficient for an industrial use, and emits light at high optical intensity, which is practically sufficient for an industrial use.

On the other hand, light emitted from a super-high pressure mercury lamp, which is used as a point light source for an ordinary exposure equipment (aligner), does not include light having a wavelength in a vacuum ultraviolet range. In other words, conventionally there is no exposure device that is equipped with a point light source (lamp) configured to emit light including the VUV light. Therefore, it is not possible to expose, for example, the SAM layer and directly create a pattern at the order of several μm without applying the photoresist process on the SAM layer.

As such, if the exposure device uses an excimer laser that emits vacuum ultraviolet light, fine patterning with the VUV light becomes possible. However, the excimer laser device, which is used as the light source, has disadvantages when compared to a lamp. Specifically, the excimer laser device is expensive and requires a large facility when compared to a lamp. Also, the excimer laser device uses a poisonous gas such as fluorine, and therefore requires equipment for removing the poisonous gas.

The present invention is proposed in view of the above-described facts, and an object of the present invention is to provide a light source device including a lamp that has a sufficiently short emission length such that the lamp can be regarded as a point light source, and that emits vacuum ultraviolet light at a high optical intensity which is practically sufficient, and to provide a light irradiating apparatus equipped with such light source device.

The inventors of the present invention found that when a flash lamp having a short interelectrode distance (i.e., short emission length) emitted light under a particular condition, the VUV light at the wavelength equal to or less than 200 nm had an intensity that was practically sufficient. The interelectrode distance is a distance between the two electrodes.

Specifically, the inventors found that if the interelectrode distance between a pair of electrodes of the flash lamp was equal to or smaller than 12.5 mm, a filler gas containing xenon gas was enclosed in an arc tube (a luminous tube) of the flash lamp, and the enclosed gas (filler gas) pressure was between 2 atm and 8 atm (between $2.03\times10^5$ Pa and $8.10\times10^5$ Pa), then the flash lamp can provide vacuum ultraviolet light having a practically sufficient intensity when the flash lamp was supplied with a current that satisfied the following condition: the time required from the start of discharge until the current value reaches its peak value is equal to or less than 8 μs, and the peak value of the current is equal to or greater than 1500 A.

When this flash lamp is used as a lamp for fine and selective surface reforming (patterning) with a mask, parallel light or substantially parallel light is needed, as described above.

For this reason, the present invention proposes a vacuum ultraviolet light source device that includes the above-described flash lamp, and an electricity feeding unit for feeding the flash lamp with the electricity. The flash lamp of the light source device is disposed in a lamp housing. A parabolic (paraboloid) mirror to convert the light emitted from the flash lamp to the parallel light to emit the parallel light in one direction is provided in the lamp housing, and a light permeable window to transmit the parallel light from the parabolic mirror is also provided in the lamp housing. The lamp housing has a gas inlet port to introduce an inert gas and a gas outlet port to expel the gas from the lamp housing, and the interior of the lamp housing is purged with the inert gas.

Accordingly, the vacuum ultraviolet light can be emitted from the light source device in the form of parallel light. In addition, the absorptive attenuation of the vacuum ultraviolet light due to oxygen is prevented by the purging with the inert gas.

If the main body of the parabolic mirror is made from a vacuum ultraviolet light permeable material, a dielectric multi-layer coat that is made from a metallic oxide layer (or layers) may be provided on the back face side of the light reflecting surface of the parabolic mirror to reflect the vacuum ultraviolet light, a planar mirror is provided in the lamp housing to reflect the light from the reflection mirror (i.e., parabolic mirror), the main body of the planar mirror is made from a vacuum ultraviolet light permeable material, and another dielectric multi-layer coat that is made from a metallic oxide layer (or layers) may be provided on the back face side of the light reflecting surface of the planar mirror to reflect the vacuum ultraviolet light, then it is possible to transmit and eliminate the light in an undesired wavelength range. If the back face side of the light reflecting surface is subjected to an atmosphere containing oxygen, it is possible to prevent the quality (property) deterioration of the dielectric multi-layer coat due to reduction, even if the temperatures of these mirrors become high.

The light source device may be used to configure a light irradiating apparatus that performs the fine and selective surface patterning process with the mask.

The light irradiating apparatus may be able to irradiate the self-assembled monolayer formed on the work with the vacuum ultraviolet light via the mask to perform the patterning process on the self-assembled monolayer.

Based on the foregoing, the present invention overcomes the problems in the following manner.

(1) According to a first aspect of the present invention, there is provided a light source device configured to emit light including vacuum ultraviolet light. The light source device includes a flash lamp having an arc tube made from a vacuum ultraviolet light permeable material, and a pair of electrodes disposed in the arc tube and facing each other. A distance between a pair of electrodes is equal to or smaller than 12.5 mm. A filler gas containing xenon gas is enclosed in the arc tube, and a pressure of the filler gas is between 2 atm and 8 atm. The light source device also includes an electricity feeding unit configured to feed the flash lamp with electricity. Time for a current fed from the electricity feeding unit to the flash lamp during emission of the flash lamp to reach a peak value from start of discharge is equal to or less than 8 μs. The peak value of the current is equal to or greater than 1500 A.

(2) According to another aspect of the present invention, there is provided a light source device according to the first aspect that may further include a lamp housing configured to house the flash lamp, a parabolic mirror disposed in the lamp housing and configured to convert light emitted from the flash lamp to parallel light and emit the parallel light in one direction, and a light permeable window disposed in the lamp housing and configured to transmit the parallel light from the parabolic mirror. The light source device may further include a gas inlet port formed in the lamp housing and configured to introduce an inert gas, and an outlet port formed in the lamp housing and configured to expel a gas from the lamp housing.

(3) According to yet another aspect of the present invention, there is provided a light source device according to the second aspect, wherein a main body of the parabolic mirror may be made from a vacuum ultraviolet light permeable material, and the light source device may further include a first dielectric multi-layer coat disposed on a back face of the parabolic mirror, which is opposite a light incident face of the parabolic mirror, and configured to reflect the vacuum ultraviolet light. The first dielectric multi-layer coat may be made from one or more metallic oxide layers, and the back face of the parabolic mirror is subjected to an atmosphere containing oxygen.

(4) According to yet another aspect of the present invention, there is provided a light source device according to the second aspect that may further include a planar mirror disposed in the lamp housing and configured to fold turn back an optical path of the parallel light emitted from the parabolic mirror. The light permeable window may be located at a position that transmits the parallel light folded back by the planar mirror.

(5) According to yet another aspect of the present invention, there is provided a light source device according to the fourth aspect that may further include an aluminum reflecting coat provided on a light reflecting face of the parabolic mirror, and a second dielectric multi-layer coat provided on a back face of the planar mirror, which is opposite a light incident face of the planar mirror, and configured to reflect the vacuum ultraviolet light. The second dielectric multi-layer coat may be made from one or more metallic oxide layers. A main body of the planar mirror may be made from a vacuum ultraviolet light permeable material, and the back face of the planar mirror may be subjected to an atmosphere containing oxygen.

(6) According to yet another aspect of the present invention, there is provided a light irradiating apparatus that includes:

a light source device according to any one of above set forth aspects and configured to emit the parallel vacuum ultraviolet light to a mask and a work in a substantially vertical direction;

a mask stage unit configured to hold the mask;

a work stage unit including a work stage to hold the work and a moving mechanism configured to rotate and move the work stage in horizontal and vertical directions;

a clearance setting mechanism configured to cause the work and the mask to approach each other and hold the work and the mask such that a desired clearance is set between the work and the mask;

a control unit configured to control the moving mechanism and the clearance setting mechanism; and an enclosing member configured to enclose an optical path from the light permeable window of the light source device to the work stage unit. Oxygen in the enclosing member may be purged with an inert gas.

(7) According to yet another aspect of the present invention, there may be provided a method of patterning a self-assembled monolayer using the light irradiating apparatus of the sixth aspect. The method may include irradiating the self-assembled monolayer formed on the work with the vacuum ultraviolet light via the mask.

(8) According to yet another aspect of the present invention, there is provided a vacuum ultraviolet light generating method of emitting light including vacuum ultraviolet light from a flash lamp, using the flash lamp and an electricity feeding unit configured to feed the flash lamp with electricity. The flash lamp includes an arc tube made from a vacuum ultraviolet light permeable material, and a pair of electrodes disposed in the arc tube and facing each other. A distance between the pair of electrodes is equal to or smaller than 12.5 mm. A filler gas containing xenon gas is enclosed in the arc tube. A pressure of the filler gas is between 2 atm and 8 atm. Time for a current fed from the electricity feeding unit to the flash lamp during emission of the flash lamp to reach a peak value from start of discharge is equal to or less than 8 μs. The peak value of the current is equal to or greater than 1500 A.

The present invention has the following advantages.

(1) A pair of electrodes are disposed in an arc tube of the flash lamp, the distance between the electrodes (interelectrode distance) is equal to or less than 12.5 mm, and a filler gas containing the xenon gas is sealedly enclosed in the arc tube at the pressure between 2 atm and 8 atm. The flash lamp is fed from an electricity feeding unit with the current that needs 8 μs or less from the start of discharge until the current reaches its peak value, with the current peak value being 1500 A or more. Therefore, the plasma temperature of the xenon gas generated upon discharge becomes high, and it is possible to emit the vacuum ultraviolet light having a high intensity.

(2) Because the flash lamp having the short interelectrode distance can be taken as the point light source having a short emission length, it is possible to emit the parallel vacuum ultraviolet light from the lamp housing if the flash lamp having the short interelectrode distance is placed in the lamp housing and the parabolic mirror is disposed in the lamp housing. As a result, the parallel vacuum ultraviolet light can be used for fine and selective surface reforming (patterning) process with a mask.

It is possible to prevent the absorptive attenuation of the vacuum ultraviolet light due to oxygen if the interior of the lamp housing is purged with the inert gas.

(3) When the main body of the parabolic mirror and the main body of the planar mirror disposed in the lamp housing are made from the vacuum ultraviolet light permeable material, and the dielectric multi-layer coat, which is made from a metallic oxide film (or films) to reflect the vacuum ultraviolet light, is provided on the back face side of the mirror opposite the light incident face of each of the mirrors, then it is also possible to transmit and remove the light component in an undesired wavelength range. If the back face side opposite the light incident face of each of the mirrors is subjected to an atmosphere containing oxygen, it is possible to prevent the quality (property) deterioration of the dielectric multi-layer coat due to reduction even if the temperature of the mirror concerned become high.

(4) The light irradiating apparatus includes a light source device having the flash lamp and the parabolic mirror, a mask stage unit for holding the mask, a work stage unit having a work stage for holding the work and a moving mechanism for rotating and moving the work stage in the vertical and horizontal directions, a clearance setting mechanism for bringing the mask (or the work) to the vicinity of the work (or the mask) and hold the mask and the work such that a desired clearance is formed between the work and the mask, a control unit for controlling the above-mentioned mechanisms respectively, and an enclosing member for enclosing an optical path from the light permeable window of the light source device to the work stage unit. By purging oxygen inside the enclosing member with the inert gas, it is possible to irradiate only that portion of the work, which is desired to have modified quality (property), with the parallel vacuum ultraviolet light through the mask. Accordingly, the fine and selective surface reforming (patterning) using the mask becomes possible.

(5) The light irradiating apparatus can perform the patterning process onto the self-assembled monolayer on the work with the vacuum ultraviolet light, without using an excimer laser or other equipment that is expensive and requires large-scaled facility.

These and other objects, aspects and advantages of the present invention will become apparent to those skilled in the art from the following detailed description when read and understood in conjunction with the appended claims and drawings.

DETAILED DESCRIPTION OF THE INVENTION

Figure 1:
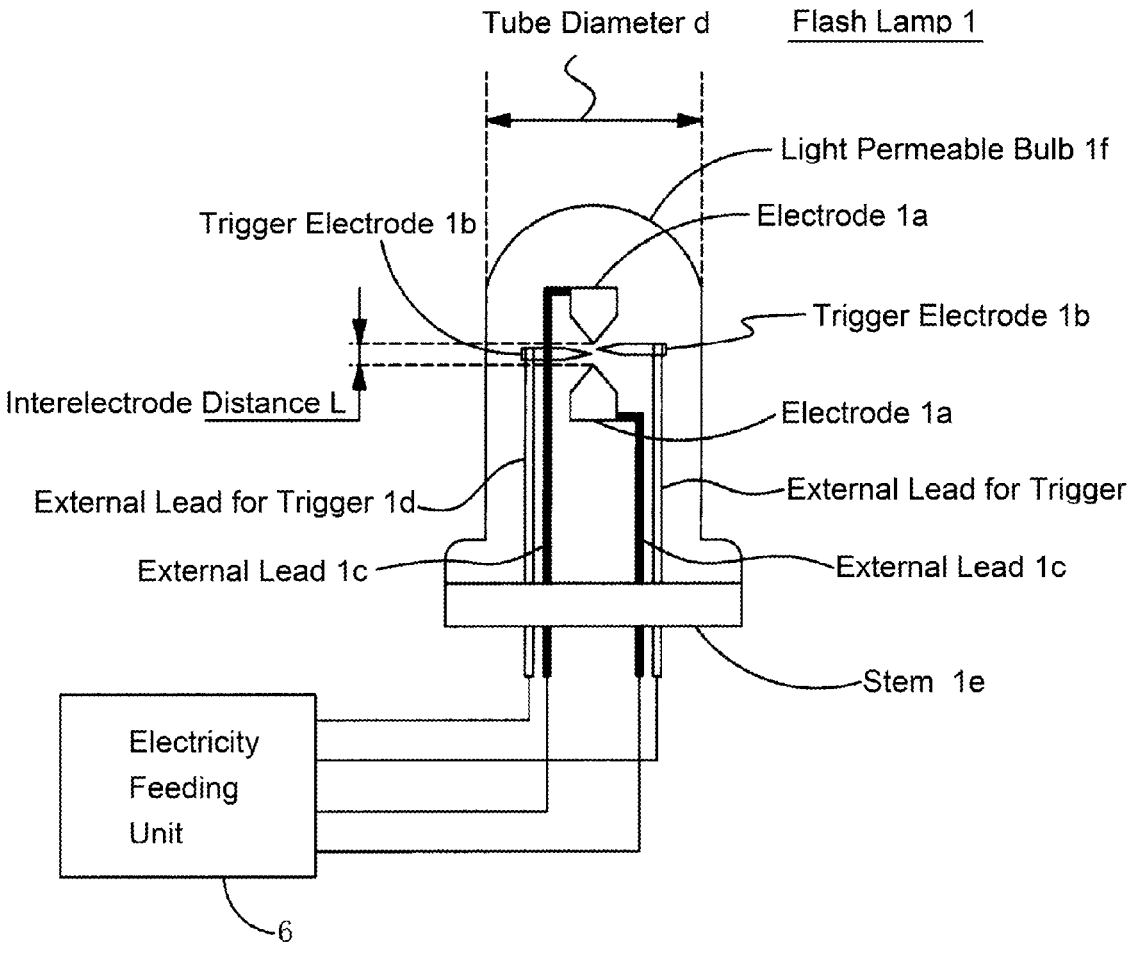
FIG. 1 illustrates an exemplary configuration of a flash lamp in an embodiment of the present invention.

Referring to FIG. 1, a structure of a flash lamp according to an embodiment of the present invention will be described.

As shown in FIG. 1, an exemplary flash lamp 1 according to the embodiment of the present invention has an arc tube (a luminous tube) and a pair of electrodes 1*a*, 1*a* provided in the arc tube. The distance between the two electrodes 1*a*, 1*a* is short such that the emission length is short and the flash lamp 1 can be regarded as a point light source. Both of external leads 1*c* extending from the two electrodes 1*a* protrude to outside from one end of the arc tube.

Specifically, the flash lamp 1 includes a light permeable bulb 1*f*, which constitutes the arc tube and has a container shape, and a stem 1*e*, which seals (closes) the opening of the light permeable bulb 1*f* (opening of the container shape). The interior of the light permeable bulb 1*f* is closed up tightly (sealed) by the stem 1*e*.

The light permeable bulb 1*f* is made from a material that transmits vacuum ultraviolet (VUV) light, such as silica glass or sapphire glass.

A pair of electrodes 1*a*, 1*a* are provided in the light permeable bulb 1*f*, which serves as the arc tube, such that the two electrodes 1*a*, 1*a* face each other in the height direction (vertical direction) of FIG. 1. Between the two electrodes 1*a*, 1*a*, there are provided a pair of trigger electrodes 1*b*, 1*b* that face each other in the width direction (horizontal direction) of FIG. 1. Xenon gas is enclosed in the light permeable bulb 1*f*.

External leads 1*c*, 1*c* (for general use) that extend from the two electrodes 1*a*, 1*a* and another external leads 1*d*, 1*d* for the triggering that extend from the two trigger electrodes 1*b*, 1*b* protrude to outside from the light permeable bulb 1*f* through the stem 1*e*. Each of the external leads 1*c*, 1*c* and 1*d*, 1*d* is sealed by the stem 1*e* such that the interior of the light permeable bulb 1*f* is maintained in a tightly sealed state. The external leads 1*c*, 1*c* and 1*d*, 1*d* that protrude to the outside from the stem 1*e* are coupled to an electricity feeding unit 6, respectively. The electricity feeding unit 6 has a capacitor (or capacitors) to store a predetermined amount of energy. As the capacitor is charged, a high voltage is applied across the paired electrodes (the first electrode 1*a* and the second electrode 1*a*) of the flash lamp 1. In the meanwhile, another electricity feeding element 6 supplies a high voltage pulse between the trigger electrodes 1*b*, 1*b*. Then, a discharge takes place between the first electrode 1*a* and the second electrode 1*a* via the trigger electrodes 1*b*, 1*b*. As a result, flashing discharge is generated in the flash lamp 1, and the electric charge accumulated on the capacitor becomes the flashing discharge and is emitted.

Figure 2:
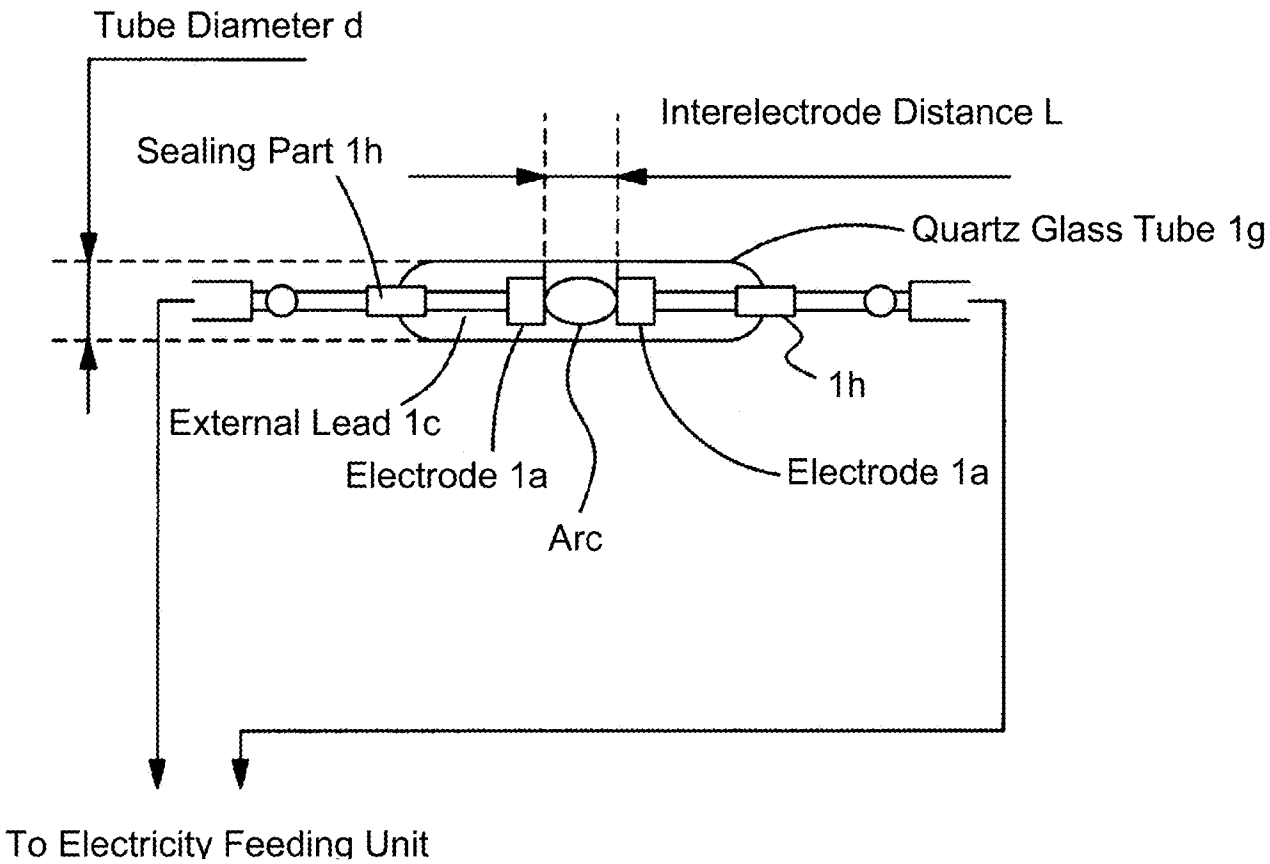
FIG. 2 illustrates another exemplary configuration of a flash lamp which may be used in an embodiment of the present invention.

It should be noted that the configuration of the flash lamp 1 is not limited to the one shown in FIG. 1 which has all the external leads 1*c*, 1*c* of the two electrodes 1*a*, 1*a* protruding to the outside from one end of the arc tube. As illustrated in FIG. 2, for example, the flash lamp 1 may have a quartz glass tube 1*g*, which is a generally straight tube and sealed at both ends thereof, and a pair of electrodes 1*a*, 1*a* disposed at both ends in the longitudinal direction of the lamp. The xenon gas is enclosed in the glass tube 1*g*. The electrodes 1*a*, 1*a* are placed inside the glass tube 1*g* or the arc tube. A sealing member 1*h* is attached to the arc tube 1*g* to seal the left external lead 1*c* that extends from one of the electrodes 1*a*, 1*a*, and another sealing member 1*h* is attached to the arc tube 1*g* to seal the right external lead 1*c* that extends from the other electrode 1*a*.

The external leads 1*c*, 1*c* that extend to the outside from the opposite ends of the arc tube 1*g* are coupled to an electricity feeding unit, respectively. The electricity feeding unit 6 has a capacitor (or capacitors) to store a predetermined amount of energy. As the capacitor is charged, a high voltage is applied between the two electrodes 1*a*, 1*a* of the flash lamp 1. With this state, a trigger spark is applied between the electrodes 1*a*, 1*a* by an igniter device (not shown), and then flashing discharge takes place in the flash lamp 1.

Figure 3A:
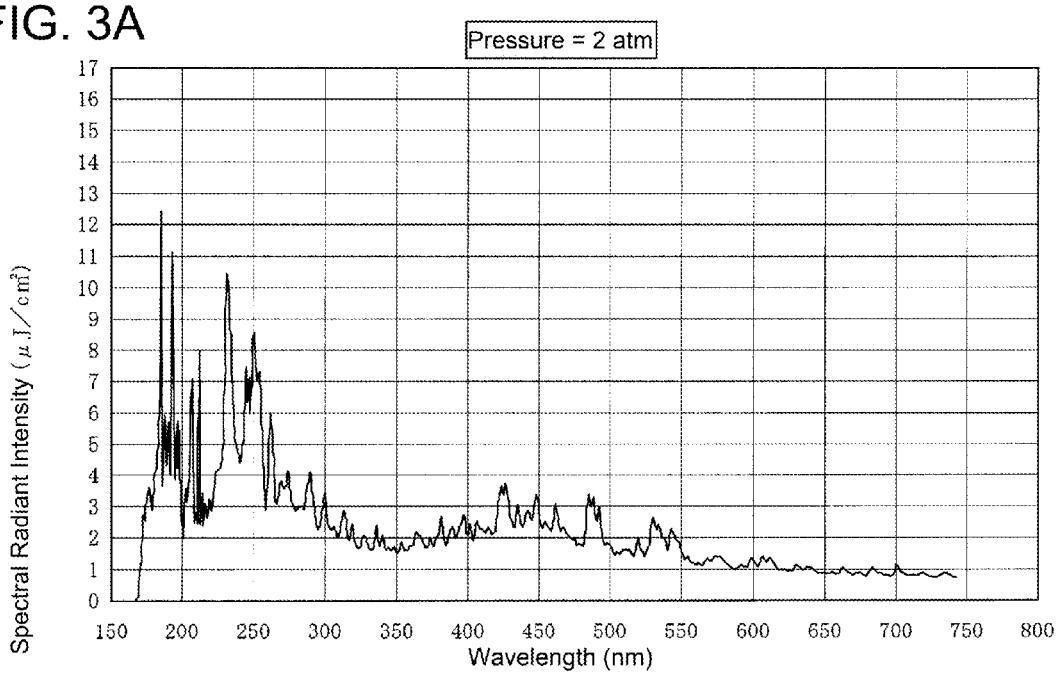
FIG. 3A shows a spectral radiant spectrum of light emitted from the flash lamp.
Figure 3B:
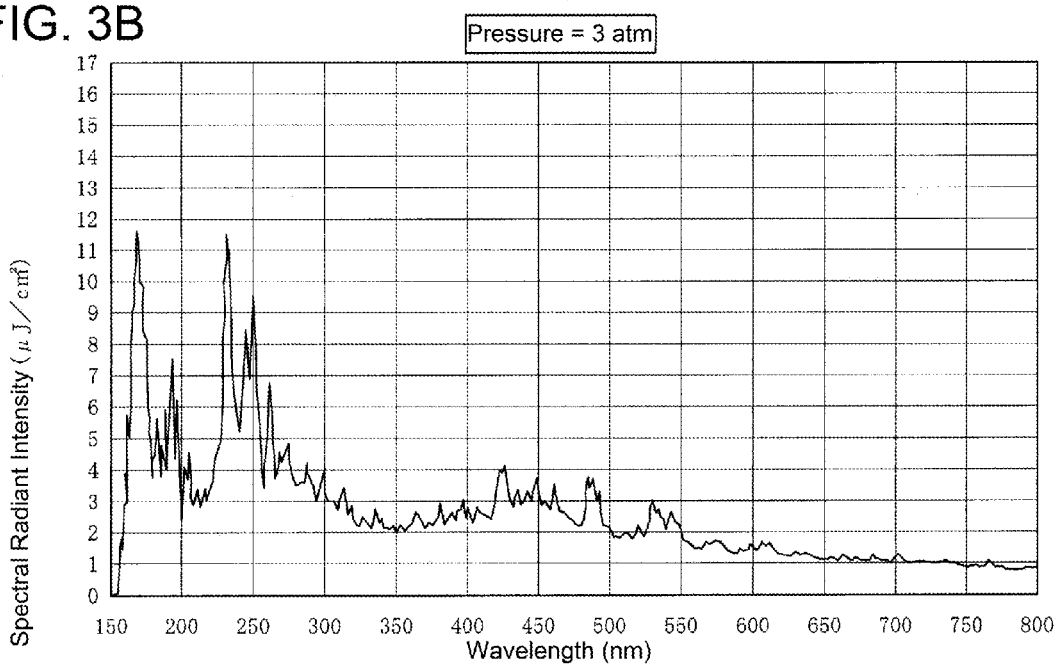
FIG. 3B shows another spectral radiant spectrum of the light emitted from the flash lamp.
Figure 4A:
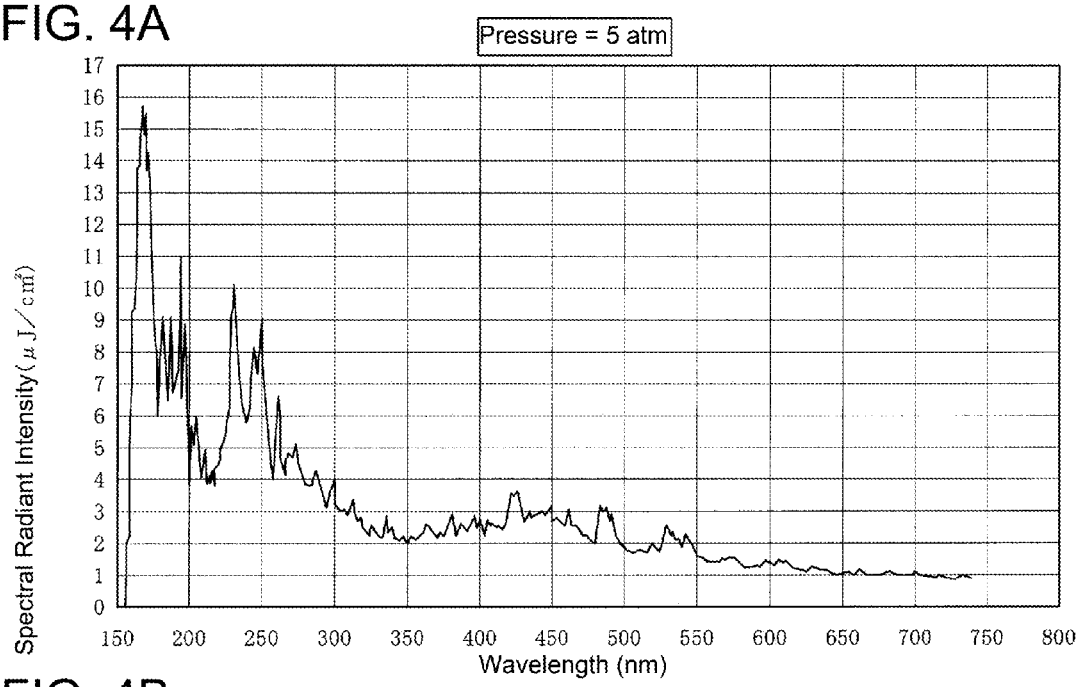
FIG. 4A shows still another spectral radiant spectrum of the light emitted from the flash lamp.
Figure 4B:
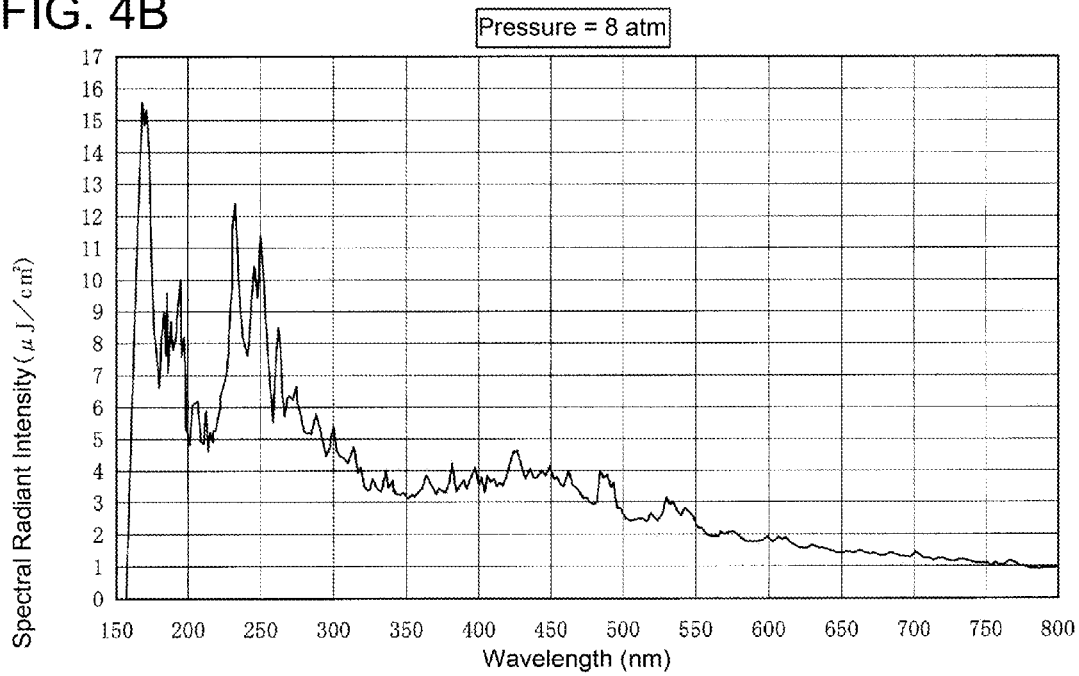
FIG. 4B shows yet another spectral radiant spectrum of the light emitted from the flash lamp.

FIGS. 3A, 3B, 4A and 4B show spectrum of light emitted from the flash lamp 1, which may be measured by a spectroradiometer. The pressure of the xenon gas enclosed in the light permeable bulb 1*f* of the flash lamp 1 is the parameter for the measured spectrum. The horizontal axis of the graph in each drawing indicates the wavelength, and the vertical axis indicates the spectral radiant intensity. FIG. 3A shows the spectral radiant spectrum when the inner pressure of the light permeable bulb 1*f* is 2 atm ($2.03\times10^5$ Pa), and FIG. 3B shows the spectral radiant spectrum when the inner pressure of the light permeable bulb 1*f* is 3 atm ($3.04\times10^5$ Pa). FIG. 4A shows the spectral radiant spectrum when the inner pressure of the light permeable bulb 1*f* is 5 atm ($5.07\times10^5$ Pa), and FIG. 4B shows the spectral radiant spectrum when the inner pressure of the light permeable bulb 1*f* is 8 atm ($8.10\times10^5$ Pa). As obvious from FIGS. 3A, 3B, 4A and 4B, when the xenon gas pressure in the light permeable bulb 1*f* is any of the above-mentioned values, the light emitted from the flash lamp includes light having a wavelength equal to or less than 200 nm.

In particular, when the xenon gas pressure in the light permeable bulb 1*f* is 3 atm, 5 atm or 8 atm, the optical intensity is large around the wavelength of 170 nm. The inventors consider that this is because the Xe excimer emission becomes large (dominant).

The inventors also found from researches and investigations that when the xenon gas pressure in the light permeable bulb 1*g* exceeded 8 atm, then the inner xenon gas expanded upon emission. Thus, the practically sufficient strength of the arc tube is difficult to ensure. This deteriorates the reliability because explosion may occur.

Therefore, when the flash lamp is employed as the point light source to emit the VUV light, it is preferred that the xenon gas pressure in the light permeable bulb be set to or lower than 8 atm.

Subsequently, the inventors studied the relationship between the rise time of the current (time required from the start of discharge until the discharge current reaches the peak value) and the energy ratio of the peak energy to the input energy of the flash lamp in the VUV range (wavelength of 150 nm to 200 nm).

As described above, the VUV light having a wavelength equal to or less than 200 nm is effective (useful) to the optical patterning process for the SAM layer or other processes. The light in the ultraviolet light range, visible light range and infrared light range, which has a wavelength over 200 nm, provides no contribution to the optical patterning process and also possibly causes the temperature elevation of the object to be irradiated (work) thereby damaging the object to be irradiated. Thus, it is preferred that the light in the ultraviolet light range, visible light range and infrared light range, which has a wavelength over 200 nm, is less included. In other words, if the energy ratio of the lamp is large in the VUV light range, it can be said that such lamp is a preferable lamp. Although the flash lamp used for the measurement of the energy ratio had the interelectrode distance of 3 mm, the inner pressure of the light permeable bulb 1*f* was 5 atm, and the xenon gas was enclosed in the bulb 1*f*, similar results (spectrum curves) are expected to be obtained even if some changes are made in the interelectrode distance, the inner pressure and the like.

Figure 5:
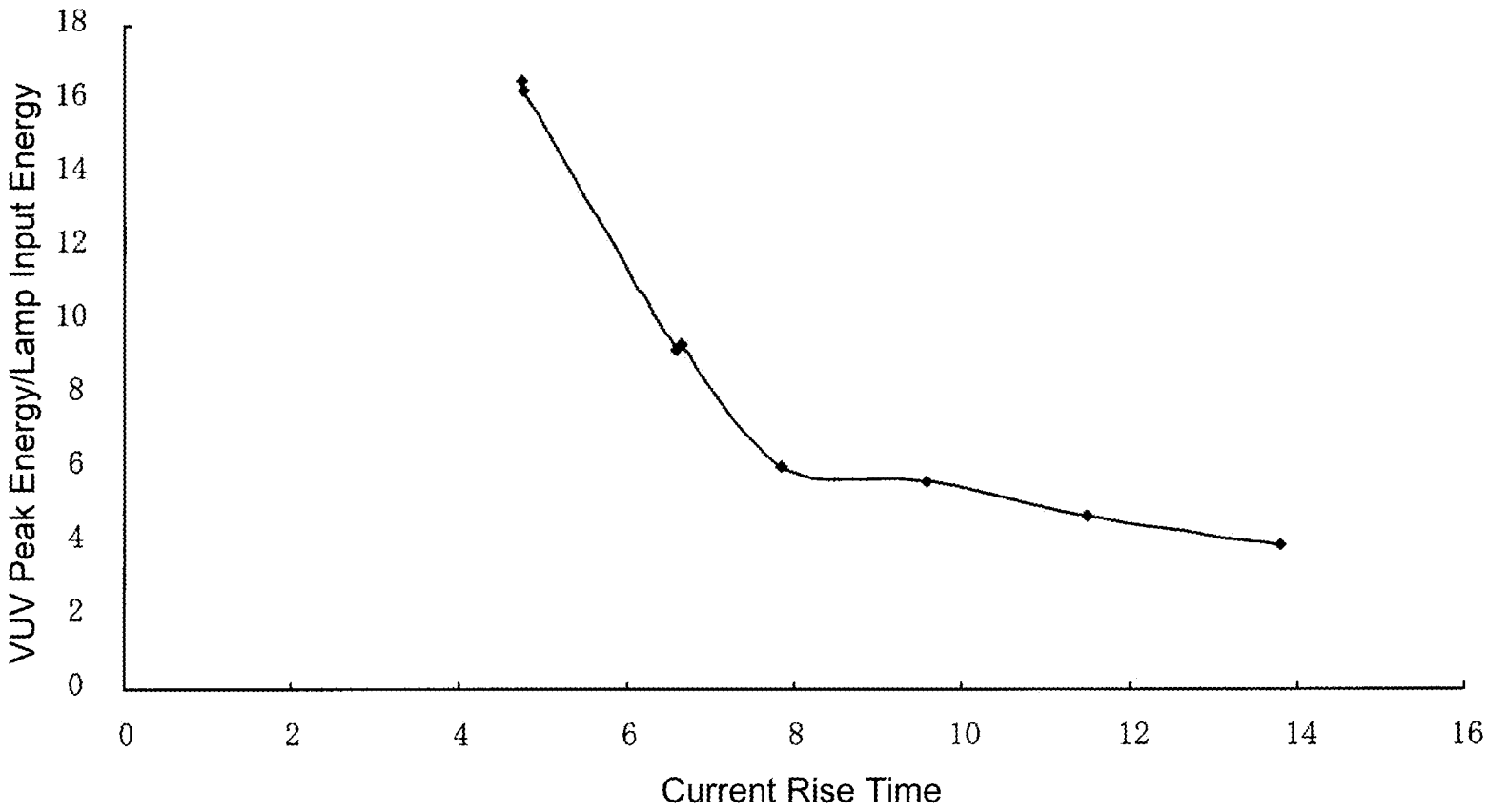
FIG. 5 depicts relationship between a rise time of a current flowing in the flash lamp and a VUV light output efficiency.

FIG. 5 shows the result of the measurement. In this drawing, the horizontal axis indicates the rise time of the current, and the vertical axis indicates the VUV efficiency of the lamp. The VUV efficiency is the ratio of the peak energy to the input energy given to the flash lamp in the VUV light range with the wavelength of 150-200 nm, as described earlier. Specifically, the VUV efficiency is calculated by dividing the peak energy, which is obtained by a sensor that is sensitive for the wavelength of 150-200 nm, by the energy applied (input energy) to the flash lamp. The adjustment in the current pulse width upon the emission of the flash lamp 1 was conducted by adjusting the capacitance of the capacitor, and the impedance and reactance of the circuit.

Specifically, the capacitance of the capacitor is 20 μF, the impedance of the circuit is 23 mΩ, and the reactance of the circuit is 0.65 μH.

In order to realize a low circuit impedance and a low circuit reactance (will be described), the capacitor is located near the lamp inside the lamp housing.

Wiring distance between the lamp and the capacitor, which influences on the discharge, is designed to be as short as possible (e.g., 30 cm or less).

As clearly understood from FIG. 5, when the current rise time (time from the start of discharge until the discharge current reaches its peak value) upon the flash lamp emission is greater than 8 μs, the VUV efficiency significantly drops. Although the reason for this VUV efficiency drop is not entirely clear, the inventors assume that the plasma temperature of the xenon gas that is generated upon discharging is influencing. In other words, when the current rise time is shorter than 8 μs, the peak power applied to the xenon, which is sealedly enclosed in the light permeable bulb 1*f*, becomes high and the plasma temperature of the xenon gas generated upon discharging becomes high, and the VUV component percentage (percentage of the light in the VUV range with the wavelength of 150-200 nm among the light emitted from the flash lamp) increases. The plasma diffuses outward over time, but if the current rise time is shorter than 8 μs, the discharge finishes before the plasma diffuses. In this case, because of the high temperature of the plasma upon the emission and other reasons, the optical intensity of the emitted light in the VUV range is large. The inventors consider that this is the reason for the drop in the VUV efficiency. It should be noted that when the current rise time is longer than 8 μs, the plasma diffuses and therefore the plasma temperature decreases. The inventors believe that this is the reason why the VUV component percentage drops.

In order to obtain such high VUV efficiency, the above-described low circuit impedance and the low circuit reactance are needed.

Figure 6:
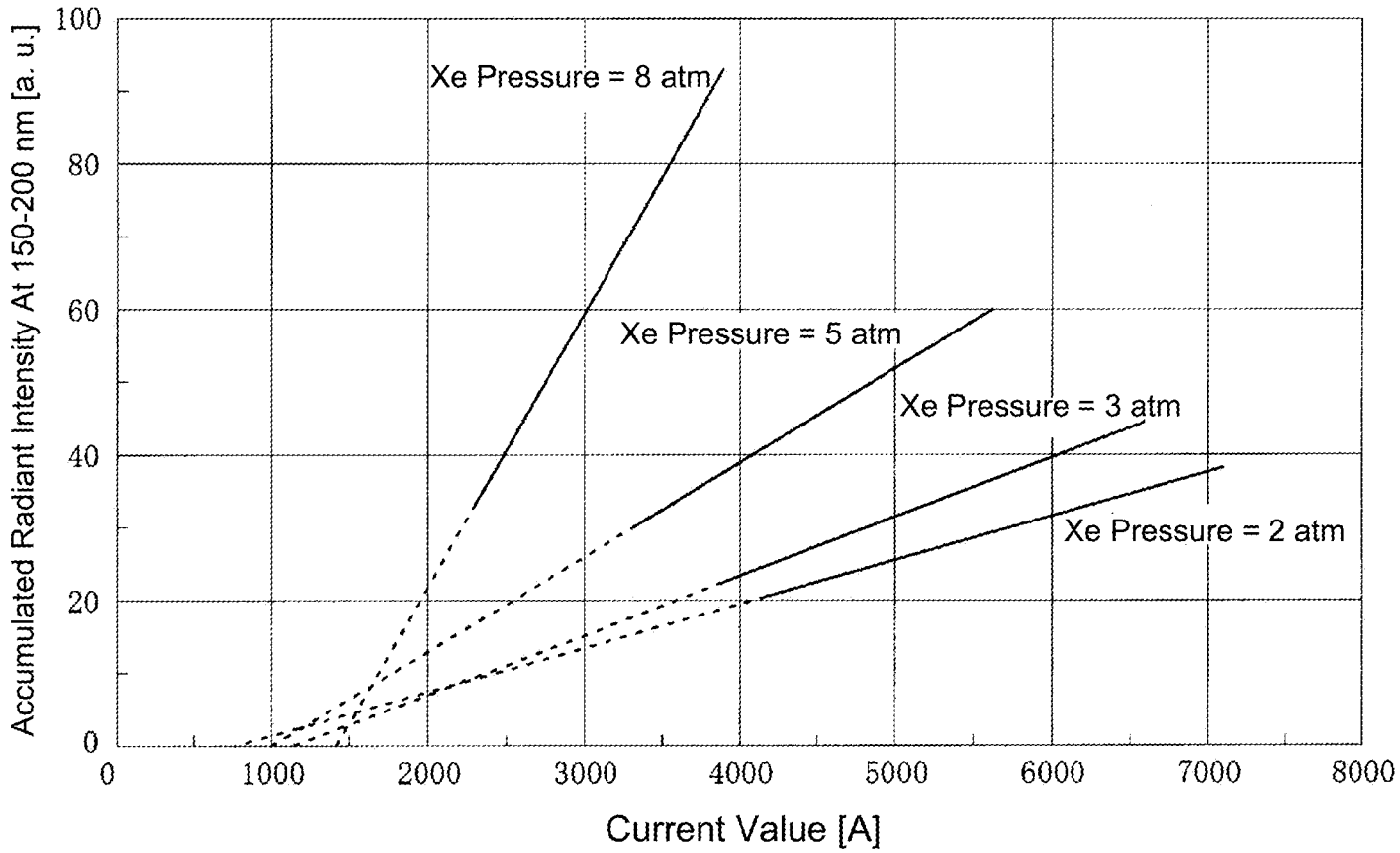
FIG. 6 depicts relationship between discharge current upon flash lamp emission and an accumulated radiant intensity of the VUV light.

Referring now to FIG. 6, the relationship between the discharge current upon emission of the flash lamp and the accumulated radiant intensity in the 150-240 nm wavelength range will be described. The parameter is the pressure of the xenon gas enclosed in the light permeable bulb. In FIG. 6, the horizontal axis indicates the peak of the current that flows between the lamp electrodes upon the emission, and the vertical axis indicates the accumulated radiant intensity in the 150-240 nm wavelength range. The values of the xenon gas pressure, which is the parameter, are 2 atm ($2.03\times10^5$ Pa), 3 atm ($3.04\times10^5$ Pa), 5 atm ($5.07\times10^5$ Pa) and 8 atm ($8.10\times10^5$ Pa).

The FWHM (full width at half maximum) of the current waveform of the lamp (hereinafter, simply referred to as "current pulse width") is 6 μs, and the current rise time is 5 μs.

As obvious from FIG. 6, the accumulated radiant intensity is substantially zero in the 150-240 nm wavelength range at any value of the xenon gas pressure when the value of the discharge current upon emission of the flush lamp is lower than 1500 A.

Therefore, when the above-mentioned flash lamp is used as the point light source to emit the VUV light, the flash lamp should be operated under the condition that the discharge current be equal to or greater than 1500 A.

In summary, if the flash lamp includes an arc tube that is made from a vacuum ultraviolet light permeable material and a pair of electrodes 1*a*, 1*a* disposed and facing each other in the arc tube, such flash lamp may be used as the vacuum ultraviolet lamp that has a sufficiently short interelectrode distance and can be regarded as a point light source, and also emits vacuum ultraviolet light at a large intensity which is practically sufficient.

In order to have the vacuum ultraviolet light at a practically sufficient intensity, it is preferred that the interelectrode distance is equal to or less than 12.5 mm, the filler gas in the arc tube is a gas containing the xenon gas, and the filler gas pressure is between 2 atm and 8 atm.

The light emitted from this flash lamp exerts less energy in that emission range which would damage the work, and has a high intensity peak in the VUV range which is effective in the optical patterning process for the SAM layer and the like. Thus, even if the lighting frequency (rate) is set to be high to obtain a necessary amount of the accumulated VUV light, a thermal damage on the work is small. This is one feature of this flash lamp.

The input energy to the lamp per each emission may be reduced by shortening the current rise time (time from the start of the discharge until the discharge current reaches the peak value) while maintaining the VUV light peak intensity at a level (or greater than this level) that can cause a chemical reaction to take place in the optical patterning process for the SAM layer or the like. If the running cost is concerned, the current rise time is set to be equal to or less than 8 μs and the flash lamp is operated to emit light repeatedly at a high speed. This ensures an appropriate amount of the VUV light accumulation, and reduces the damages to the work. In addition, because the load on the flash lamp decreases, the flash lamp is expected to have a longer life.

Figure 7:
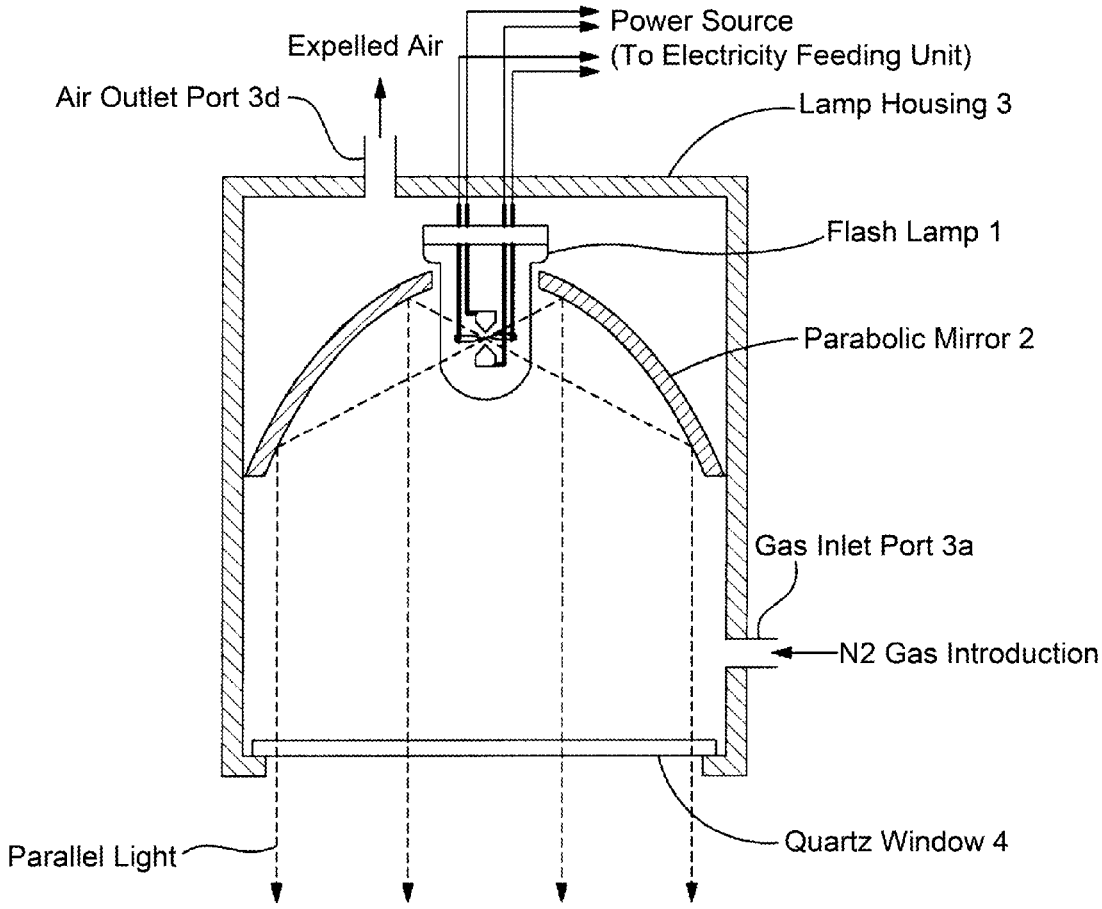
FIG. 7 illustrates a vacuum ultraviolet light source device according to a first embodiment of the present invention.

Now, an exemplary vacuum ultraviolet light source device when an illumination optical system is configured with the flash lamp of this embodiment will be described. FIG. 7 shows a schematic structure of the light source device according to a first example (embodiment) of the present invention.

The flash lamp 1 and a parabolic mirror 2 are provided in a lamp housing 3. Leads (external leads for general use and external leads for triggering) that extend from the flash lamp 1 are connected to an electricity feeding unit (not shown), which is a power source for the lamp. The interelectrode distance of the flash lamp 1 is 3 mm, and the xenon gas pressure in the flash lamp 1 is 5 atm.

The light emitted from the flash lamp 1 is converted to the parallel light through the parabolic mirror 2, and then emitted out of the lamp housing 3 from a quartz window 4. The light permeable window that transmits the light emitted from the flash lamp 1 is the quartz window 4 made from, for example, a synthetic quartz that has a high transmissivity (transmittance) to the VUV light.

It should be noted that the material of the light permeable window 4 may be a sapphire glass, which has a greater light permeability for a shorter wavelength than the quartz, or may be calcium fluoride or magnesium fluoride, if necessary.

The quartz window 4 is airtightly attached to the lamp housing 3, and an inert gas such as nitrogen ($N_2$) gas may be introduced to the interior of the lamp housing 3 from a gas inlet port 3*a* of the lamp housing 3 to purge the interior of the lamp housing 3. This purging may be necessary because the VUV light is subject to absorptive attenuation severely by oxygen. By purging the interior of the lamp housing 3 with the inert gas such nitrogen gas, it is possible to prevent the absorptive attenuation of the VUV light which would otherwise be caused by oxygen. The inert gas such as nitrogen gas introduced into the lamp housing 3 cools the flash lamp 1 and the parabolic mirror 2, and then is expelled to the outside from an outlet port 3*d* of the lamp housing 3.

Aluminum is vapor deposited on an inner face (light reflecting surface) of the parabolic mirror 2 such that an aluminum reflecting coat is formed on the parabolic mirror 2. Aluminum is a suitable material for the mirror because aluminum efficiently reflects the VUV light. It should be noted, however, that if the pressure of the xenon gas enclosed in the light permeable bulb of the flash lamp 1 is relatively low or the value of the discharge current is relatively small as described above, or when the current pulse width is relatively long, then the energy percentage of the VUV light decreases and the energy percentage of the light having a long wavelength which exceeds 200 nm increases.

If it is necessary to attenuate the light in such long wavelength range due to limitations such as the heat resistant temperature of the irradiated object or other reasons, a dielectric material (or dielectric materials) may be vapor deposited in a plurality of layers on the inner face (light reflecting surface) of the parabolic mirror 2, instead of aluminum, and the mirror having the dielectric multi-layer coat is used. The mirror having the dielectric multi-layer coat has a capability of reflecting the light in a desired wavelength range and transmitting and eliminating the light in a non-desired wavelength range.

The vapor deposition material of the dielectric multi-layer coated mirror is often a metallic oxide. The metallic oxide is commonly used because the metallic oxide is relatively inexpensive, and the vapor deposition technique for the metallic oxide is established. It should be noted, however, that if the dielectric multi-layer coat is exposed to a high temperature in an inert gas atmosphere, the dielectric multi-layer coat is reduced to a metallic coat (film or films) or the dielectric constant changes due to the change in the oxygen-related composition. This may result in the change in the reflecting wavelength of the dielectric multi-layer coat of the mirror. When the lamp is used for a long time and the mirror temperature is elevated to a high temperature due to a radiant heat from the lamp, then the above-mentioned drawback may occur.

Figure 8A:
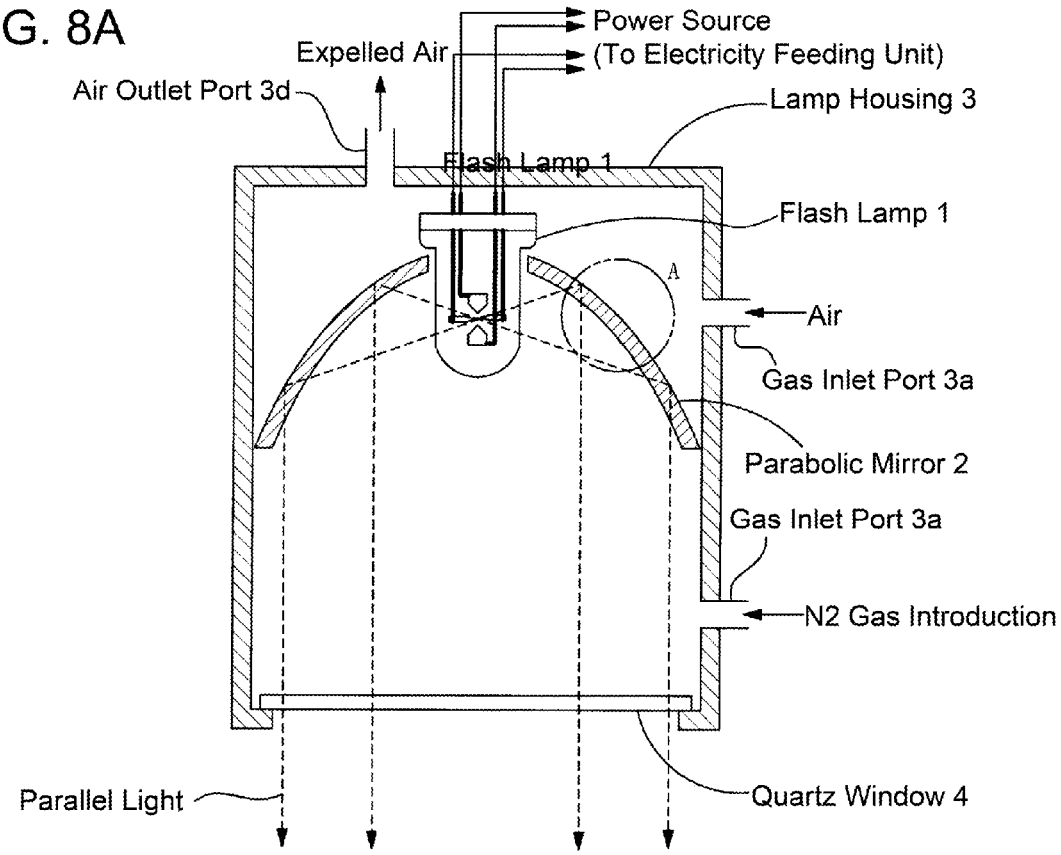
FIG. 8A illustrates a vacuum ultraviolet light source device according to a second embodiment of the present invention.
Figure 8B:
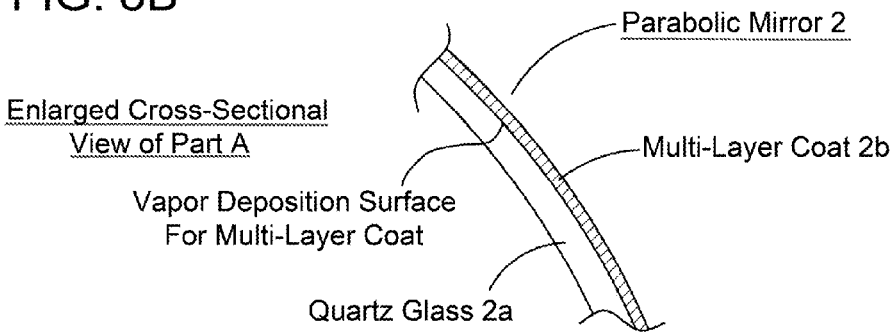
FIG. 8B is an enlarged cross-sectional view of the part A in FIG. 8A.

FIG. 8A illustrates a configuration of a vacuum ultraviolet light source device according to a second embodiment of the present invention. The embodiment of FIG. 8A is directed to the light source device that can prevent the change in the reflecting wavelength of the dielectric multi-layer coat which is vapor deposited on the light reflecting surface of the parabolic mirror 2. When compared to the light source device shown in FIG. 7, the light source device shown in FIG. 8A additionally includes an air inlet port 3*b* on the back face side of the parabolic mirror 2. FIG. 8B is an enlarged cross-sectional view of the part A of the parabolic mirror 2 shown in FIG. 8A. Unlike the configuration shown in FIG. 7, the dielectric multi-layer coat 2*b* of the parabolic mirror 2 is not vapor deposited on the inner face of the parabolic mirror 2 but on the back face of the parabolic mirror 2. In addition, the material of the parabolic mirror 2 is a vacuum ultraviolet light permeable material. For example, a quartz glass 2*a* is used as the material of the parabolic mirror 2. With such configuration, the dielectric multi-layer coat, which is primarily constituted by the metallic oxide, is placed in an atmosphere containing oxygen because the air is introduced to the back face side of the parabolic mirror 2 through the air inlet port 3*b* and the dielectric multi-layer is disposed on the back face of the parabolic mirror 2. Therefore, even if the temperature of the parabolic mirror 2 becomes high, the dielectric multi-layer coat is not reduced and the reflecting feature of the dielectric multi-layer coat does not change.

The VUV light penetrates the quartz glass 2*a* of the main body of the parabolic mirror 2 and is reflected by the dielectric multi-layer coat 2*b* applied on the back face of the quartz glass 2*a*. Then, the VUV light penetrates the quartz glass 2*a* of the parabolic mirror 2 again, and is converted to parallel light. Subsequently, the VUV light exits the lamp housing 3 from the quartz window 4. Because the space between the parabolic mirror 2 and the quartz window 4 is still in a purged condition with the inert gas such as nitrogen ($N_2$) gas, the VUV light is not attenuated due to absorption. It is preferred to keep the balance between the flow rate of the inert gas, such as nitrogen gas, and the flow rate of the air and the flow rate and pressure of the expelled gas such that the air does not flow toward the inner face side (i.e., optical path side) of the parabolic mirror 2.

Figure 9A:
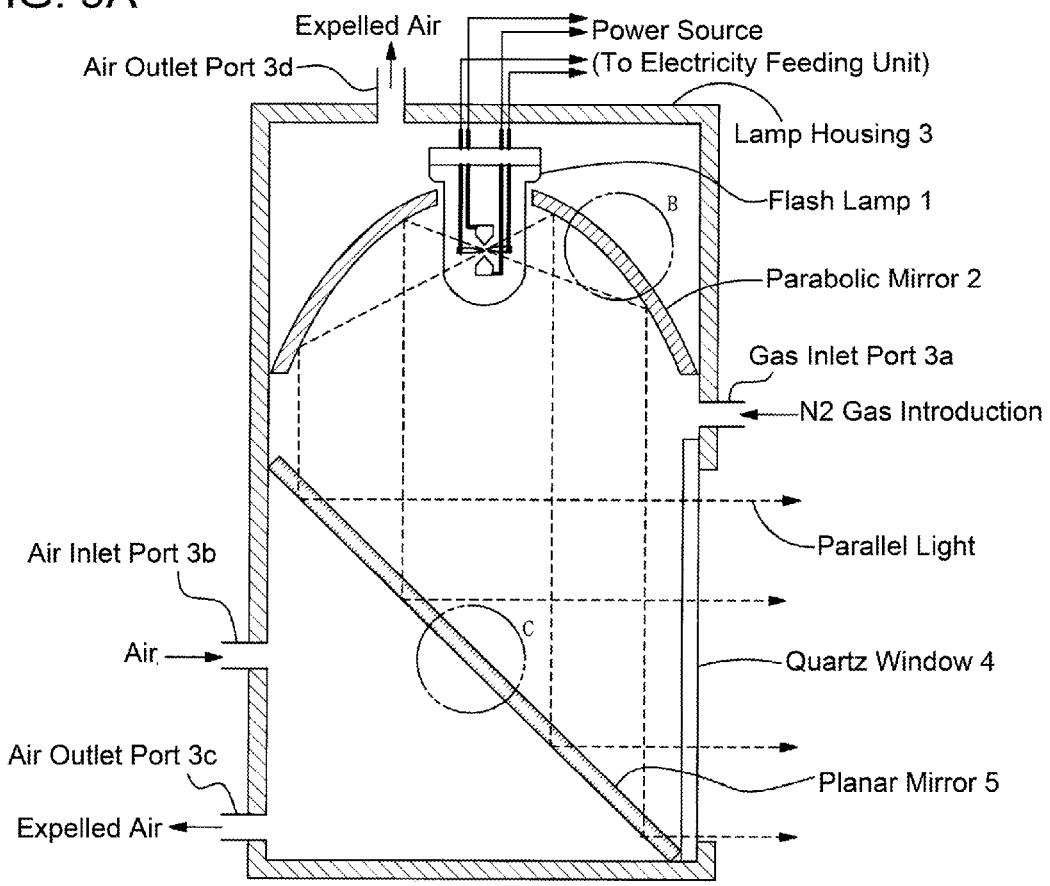
FIG. 9A illustrates a vacuum ultraviolet light source device according to a third embodiment of the present invention.

FIG. 9A illustrates a configuration of a vacuum ultraviolet light source device according to a third embodiment of the present invention. The embodiment shown in FIG. 9A is different from the embodiment shown in FIG. 8A. Manufacturing processes, such as bending and heat molding (hot forming), are necessary to fabricate the parabolic mirror 2, but a considerable cost is required to fabricate a parabolic mirror from the quartz glass which has a high softening point temperature. In addition, a precise layer (film) thickness control is needed in the process of vapor depositing the dielectric material (s) in a multi-layer structure to obtain the dielectric multi-layer, but the layer thickness control to the dielectric multi-layer coat is difficult when the vapor deposition surface is bending. Therefore, the vapor deposition process is more costly when the parabolic mirror 2 is fabricated from the quart glass than when the parabolic mirror is fabricated from aluminum, which requires less precise control for the layer thickness control, if the vapor deposition surface is a bending surface.

Figure 9B:
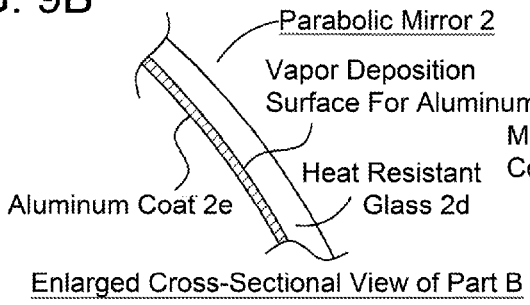
FIG. 9B is an enlarged cross-sectional view of the part B in FIG. 9A.

An exemplary configuration of the light source device that can overcome these problems is shown in FIGS. 9A and 9B, and a planar mirror 5 is provided on the light emission side of the parabolic mirror 2. As illustrated in FIG. 9B, which is the enlarged view of the part B of FIG. 9A, the main body of the parabolic mirror 2 is made from glass, such as borosilicate glass (heat resistant glass 2*d*), that can easily be heat molded at a lower temperature than the quartz. An aluminum coat 2*e* is vapor deposited on the inner face (light reflecting surface) of the parabolic mirror 2. The light emitted from the flash lamp 1 and converted to parallel light by the parabolic mirror 2 includes long wavelength light, and such light is incident on the planar mirror 5.

Figure 9C:
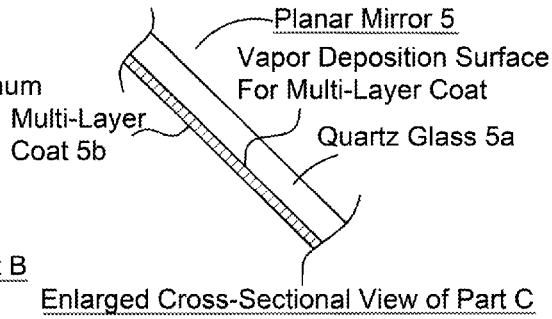
FIG. 9C is an enlarged cross-sectional view of the part C in FIG. 9A.

A main body of the planar mirror 5 is made from a vacuum ultraviolet permeable material. As shown in FIG. 9C, which is the enlarged view of the part C of FIG. 9A, the main body of the planar mirror 5 is made from, for example, quartz glass 5*a*. A dielectric multi-layer coat 5*b* is vapor deposited on a back face of the planar mirror 5. The light introduced from the parabolic mirror 2 having the long wavelength component penetrates the quarts glass 5*a* of the main body of the planar mirror 5, and is incident on the dielectric multi-layer coat 5*b* applied on the back face of the quartz glass 5*a*. Most of the long wavelength component of the incident light penetrates the dielectric multi-layer coat 5*b* and passes over the back face of the planar mirror 5 whereas the VUV light (VUV component) of the incident light is reflected by the dielectric multi-layer coat 5*b*, penetrates the quartz glass 5*a* again, and is emitted from the planar mirror 5. In this manner, the light that has the reduced long wavelength component and the increased VUV light percentage exits the lamp housing 3 from the quarts window 4.

The lamp housing 3 has an air inlet port 3*b* and an air outlet port 3*c* on the back face side of the planar mirror 5. Air is introduced into the lam housing 3 from the air inlet port 3*b*, and is expelled from the air outlet port 3*c* such that the space, which the dielectric multi-layer coat of the planar mirror 5 faces, becomes an atmosphere containing oxygen and therefore no changes take place in the qualities (properties) due to the reduction even when the temperature of the planar mirror 5 becomes high. The space enclosed by the parabolic mirror 2, the planar mirror 5 and the quartz window 4 is purged by an inert gas, such as nitrogen gas ($N_2$), which is introduced from a gas inlet port 3*a*, and therefore the absorptive attenuation of the VUV light, which would be otherwise caused by oxygen, does not occur.

Although the planar mirror 5 is made from the quartz glass, the planar mirror 5 has a simple flat shape and therefore the heat molding is not needed. Furthermore, the layer thickness control to be performed when the dielectric multi-layer coat is prepared by the vapor depositing process is easy. Accordingly, the fabrication cost for the planar mirror 5 is low. It should also be noted that this configuration provides another advantage (synergistic effect). Specifically, because the space on the inner side of the parabolic mirror 2 is an inert gas (e.g., nitrogen gas) atmosphere, it is possible to prevent the oxidization-based deterioration of the aluminum on the vapor deposition surface of the parabolic mirror 2.

In the foregoing, the embodiments of the light source device are described. It is then possible to make a light irradiating apparatus for mask pattern exposure if the light source is combined with a work stage and a mask stage. A microscope for alignment may be also combined if necessary. That part of the light irradiating apparatus, through which the VUV light passes, is subjected to or placed in an inert gas (e.g., nitrogen gas ($N_2$)) atmosphere.

Figure 10:
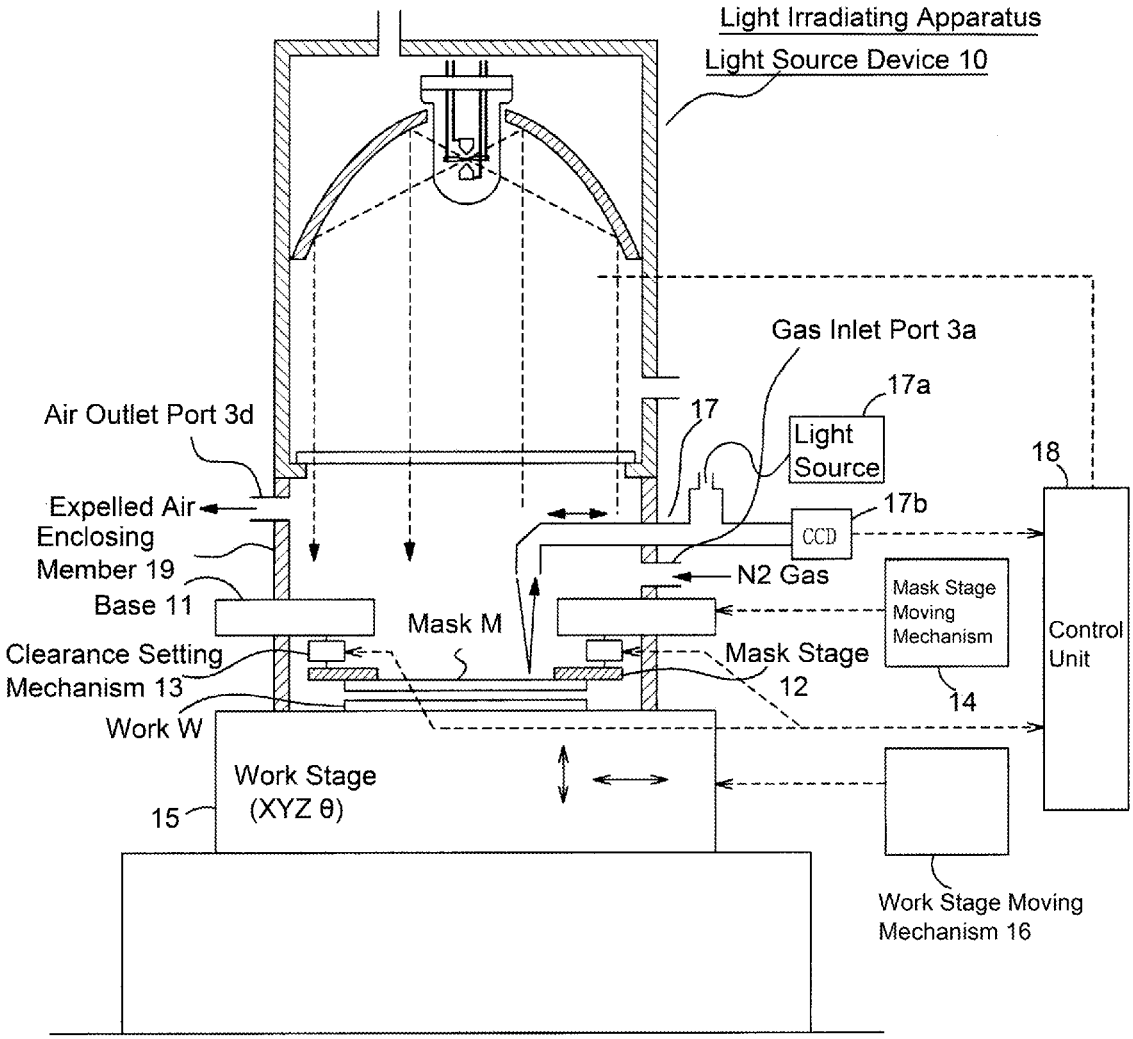
FIG. 10 shows an exemplary configuration of a light irradiating apparatus that incorporates an exemplary vacuum ultraviolet light source device according to the present invention.

FIG. 10 illustrates an exemplary configuration of the light irradiating apparatus that incorporates the exemplary light source device 10 of the present invention.

In this drawing, the VUV light, which is emitted from the vacuum ultraviolet light source device 10 shown in FIGS. 7 and 8A or other drawings is the parallel light, and incident on a mask M. The mask M shown in FIG. 10 is prepared by, for example, vapor depositing a metal (e.g., chrome) on a transparent substrate (e.g., glass substrate) and etching the deposited metal for patterning. The reference sign "W" designates the work. The work W is irradiated with the VUV light that passes through the mask M.

The mask M is spaced from the work W by approximately 100 μm, and a gas layer containing oxygen is formed between the mask M and the work W. The work W is placed on the work stage 15 and fixed on the work stage 15 by means of, for example, a vacuum chuck.

The reference numeral 11 indicates a base to support the mask stage 12. The mask stage 12 holds the mask M. The mask stage 12 is equipped with a positioning mechanism to place (set) the mask M at a desired position, and the vacuum chuck to hold the mask by vacuum suction. The reference numeral 13 designates clearance setting mechanisms. The clearance setting mechanisms 13 are provided at least three positions between the base 11 and the mask stage 12 such that the mask M is set to be parallel to the work W at the predetermined (constant) clearance (will be described).

The reference numeral 14 designates a mask stage moving mechanism to move the mask stage 12 to a desired (predetermined) location. The work stage 15 is configured such that the work stage 15 is moved in X-direction (right and left directions or horizontal direction in FIG. 10), Y-direction (direction perpendicular to the drawing sheet) and Z-direction (vertical direction in FIG. 10) and rotated in θ-direction (rotating direction about the axis extending in a direction perpendicular to the stage plane in FIG. 10) by a work stage moving mechanism 16. Similar to the mask stage 12, the work stage 15 is equipped with a positioning mechanism to place (set) the work W at a desired position, and a vacuum chuck to hold the work W by vacuum suction.

The reference numeral 17 designates the microscope for alignment, which is used to cause an alignment mark provided on the mark M to match an alignment mark provided on the work W. The alignment microscope 17 has a light source 17*a* to emit alignment light (usually, visible light), and a CCD sensor 17*b*. The mask/work is irradiated with the light from the light source 17*a*, and the reflecting light from the mask/work is received by the CCD sensor 17*b* so as to cause the alignment mark of the mask M to match the alignment mark of the work W.

The reference numeral designates a control unit. The control unit 18 includes a processor and other components, and controls the position of the mask M with the mask stage moving mechanism 14 and the position of the work W with the work stage moving mechanism 16. The control unit 18 also controls the clearance setting mechanism 13 and the light source device 10.

An enclosing member 19 is provided between the light emitting side of the light source device 10 and the base 11 to enclose the optical path, through which the light emitted from the light source device 10 and directed to the work proceeds. The enclosing member 19 contacts the work stage 15 via the base 11. It should be noted that the work stage 15 moves downward in the Z-direction when, for example, the work W is loaded on or unloaded from the work stage 15, spacing is created between the work stage 15 and the enclosing member 19.

When the front end of the enclosing member 19 contacts the work stage 15, the inner space defined by the quartz window 4 of the light source device 10, the enclosing member 19, the base 11 and the work stage 15 is the closed space.

When this closed space is established, the interior of the enclosing member 19 may be purged with an inert gas such as nitrogen ($N_2$) gas which may be introduced from the gas inlet port 3*a* of the enclosing member 19. This purging may be carried out because the VUV light emitted from the light source device 10 is subjected to significant absorptive attenuation by oxygen. By purging the interior of the lamp housing 3 with the inert gas such as nitrogen gas, it is possible to avoid the absorptive attenuation of the VUV light by oxygen. The inert gas such as nitrogen gas introduced into the interior of the enclosing member 19 may be discharged from an outlet port 3*d* of the enclosing member 19.

In FIG. 10, the process of irradiating the work W with the VUV light is carried out in the following manner. Firstly, the mask M is placed at a predetermined position on the mask stage 12 and held at this position by vacuum suction. Subsequently, the work stage 15 is moved downward by the work stage moving mechanism 16, and the work W is placed on the work stage 15 and held by vacuum suction. Then, the work stage 15 is moved in the X-direction, the Y-direction and/or the θ-direction to position the work W under the mask M. After that, the control unit 18 causes the work stage moving mechanism 16 to move the work stage 15 upward such that the work W contacts the mask M. Then, the work W is further moved upward.

The clearance setting mechanisms 13 are provided between the mask stage 12 and the base 11 at least three locations. Each of the clearance setting mechanisms 13 has a compression coil therein, and the compression coil of each clearance setting mechanism 13 is able to displace independently from the coil springs of the other clearance setting mechanisms 13. Therefore, even if the work W is tilted relative to the mask M and the clearance between the work W and the mask M is not uniform, the inclination of the mask M becomes equal to the inclination of the work W as the work W is forced to contact the mask M and to further move upward because the coil springs of the clearance setting mechanisms 13 displace in different amounts respectively and the entire surface of the mask M contacts the work W. Then, the control unit 18 holds the displacements of the respective clearance setting mechanisms 13, and causes the work stage 15 to descend by a desired distance.

By providing the clearance setting mechanisms 13 in the above-described manner, it is possible to ultimately hold the work W and the mask M in a parallel relation with the constant (desired) clearance, even if the work W placed on the work stage 15 is not parallel to the mask M. After the clearance between the work W and the mask M is set to the constant value, the work stage moving mechanism 16 moves the work stage 15 in the X-direction, the Y-direction and/or the θ-direction such that the alignment mark on the mask M matches the alignment mark on the work W.

Specifically, the focal point of the alignment microscope 17 is adjusted such that the images of the alignment marks of the mask M and work W are captured by the CCD sensor 17*b*. Then, the position of the work stage 15 is adjusted such that the alignment mark of the mask M and the alignment mark of the work M overlap. This adjustment may be automatically performed by the control unit 18 or may be manually performed by an operator who looks at the alignment marks of the mask M and work W with the alignment microscope 17. As the alignment process for the work W and mark M finishes, the alignment microscope 17 is retracted from above the mask M as indicated by the arrow in FIG. 10. It should be noted that if the alignment microscope 17 is located in a non-irradiated area above the mask M, the alignment microscope 17 may not be retracted.

When the alignment mark of the mask M matches the alignment mark of the work W, the mask M is irradiated with the VUV light, which is the parallel light, emitted from the light source device 10 such that, for example, the optical patterning for the SAM layer on the work W is performed. Upon finishing the VUV light irradiation, the work stage 15 is lowered, the application of the vacuum to the work stage 15 is stopped, and the irradiated work W is taken from the work stage 15. As described above, the light irradiating apparatus of this embodiment can perform the optical patterning process on the work W because the mask M having a pattern formed thereon is prepared, the mask M is moved to the vicinity of the work W such that the mask M extends in parallel to the work W, and that part of the work W which is expected to have a modified quality is only irradiated with the parallel ultraviolet light via the mask M.

Although the work stage 15 is moved in the Z-direction to set (decide) the clearance between the mask M and the work W in the foregoing, another approach may be employed. For example, a mechanism for moving the base 11 in the Z-direction may be provided to set the clearance between the mask M and the work W. Alternatively, the clearance setting mechanisms may be provided between the work stage 15 and the work W.

When the VUV light emitted onto the work W from the above-described light irradiating apparatus needs to have a uniform illuminance distribution, the light irradiating apparatus may be configured in the following manner.

The parabolic mirror 2 of the light source device 10 is replaced with an oval focusing mirror, and the light emitting part of the flash lamp 1 is located at a first focal point of the oval focusing mirror. In addition, an integrator is placed at a second focal point where the light exiting the quartz window 4 is focused, and the light from the integrator is converted to parallel light by a collimator lens or collimator mirror, and the mask M is irradiated with the parallel light.

Because the integrator and the collimator lens or the collimator mirror are situated on the optical path, along which the light emitted from the light source device 10 and directed to the work W proceeds, the integrator and the collimator lens or the collimator mirror are also located in the enclosing member 19.

While certain embodiments have been described, these embodiments have been presented by way of example only, and are not intended to limit the scope of the present invention. The novel devices, apparatuses and methods thereof described herein may be embodied in a variety of other forms. Furthermore, various omissions, substitutions, modifications and changes in the form of the devices, apparatuses and methods thereof described herein may be made without departing from the gist of the present invention. The accompanying claims and their equivalents are intended to cover such forms of modifications as would fall within the scope and gist of the present invention.

The present application is based upon and claims the benefit of a priority from Japanese Patent Application No. 2013-118651, filed Jun. 5, 2013, and the entire content of this Japanese Patent Application is incorporated herein by reference.

What is claimed is:

1. A light source device configured to emit light including vacuum ultraviolet light comprising:

a flash lamp including an arc tube made from a vacuum ultraviolet light permeable material, and a pair of electrodes disposed in the arc tube and facing each other, a distance between the pair of electrodes being equal to or smaller than 12.5 mm, with a filler gas containing xenon gas being enclosed in the arc tube and a pressure of the filler gas being between 2 atm and 8 atm; and an electricity feeding unit configured to feed the flash lamp with electricity, time for a current fed from the electricity feeding unit to the flash lamp during emission of the flash lamp to reach a peak value from start of discharge being equal to or less than 8 μs, and the peak value of the current being equal to or greater than 1500 A.

2. The light source device according to claim 1 further comprising:

a lamp housing configured to house the flash lamp;

a parabolic mirror disposed in the lamp housing and configured to convert light emitted from the flash lamp to parallel light and emit the parallel light in one direction;

a light permeable window disposed in the lamp housing and configured to transmit the parallel light from the parabolic mirror;

a gas inlet port formed in the lamp housing and configured to introduce an inert gas; and an outlet port formed in the lamp housing and configured to expel a gas from the lamp housing.

3. The light source device according to claim 2, wherein a main body of the parabolic mirror is made from a vacuum ultraviolet light permeable material, the light source device further comprises a first dielectric multi-layer coat disposed on a back face of the parabolic mirror, which is opposite a light incident face of the parabolic mirror, and configured to reflect the vacuum ultraviolet light, the first dielectric multi-layer coat is made from one or more metallic oxide layers, and the back face of the parabolic mirror is subjected to an atmosphere containing oxygen.

4. The light source device according to claim 2 further comprising a planar mirror disposed in the lamp housing and configured to fold back an optical path of the parallel light emitted from the parabolic mirror, wherein the light permeable window is located at a position that transmits the parallel light folded back by the planar mirror.

5. The light source device according to claim 4 further comprising:

an aluminum reflecting coat provided on a light reflecting face of the parabolic mirror; and a second dielectric multi-layer coat provided on a back face of the planar mirror, which is opposite a light incident face of the planar mirror, and configured to reflect the vacuum ultraviolet light, the second dielectric multi-layer coat being made from one or more metallic oxide layers, wherein a main body of the planar mirror is made from a vacuum ultraviolet light permeable material, and the back face of the planar mirror is subjected to an atmosphere containing oxygen.

6. A light irradiating apparatus comprising:

a light source device according to claim 2 and configured to emit the parallel vacuum ultraviolet light to a mask and a work in a substantially vertical direction;

a mask stage unit configured to hold the mask;

a work stage unit including a work stage to hold the work and a moving mechanism configured to rotate and move the work stage in horizontal and vertical directions;

a clearance setting mechanism configured to cause the work and the mask to approach each other and hold the work and the mask such that a desired clearance is set between the work and the mask;

a control unit configured to control the moving mechanism and the clearance setting mechanism; and an enclosing member configured to enclose an optical path from the light permeable window of the light source device to the work stage unit, with oxygen in the enclosing member being purged with an inert gas.

7. A method of patterning a self-assembled monolayer using the light irradiating apparatus of claim 6, comprising:

irradiating the self-assembled monolayer formed on the work with the vacuum ultraviolet light via the mask.

8. A vacuum ultraviolet light generating method of emitting light including vacuum ultraviolet light from a flash lamp, using the flash lamp and an electricity feeding unit configured to feed the flash lamp with electricity, the flash lamp including an arc tube made from a vacuum ultraviolet light permeable material, and a pair of electrodes disposed in the arc tube and facing each other, a distance between the pair of electrodes being equal to or smaller than 12.5 mm, a filler gas containing xenon gas being enclosed in the arc tube, a pressure of the filler gas being between 2 atm and 8 atm, and time for a current fed from the electricity feeding unit to the flash lamp during emission of the flash lamp to reach a peak value from start of discharge being equal to or less than 8 μs, and the peak value of the current being equal to or greater than 1500 A.

* * * * *